US010366851B2

(12) United States Patent
Tanaka et al.

(10) Patent No.: US 10,366,851 B2
(45) Date of Patent: Jul. 30, 2019

(54) SWITCH DEVICE AND DETECTING APPARATUS EQUIPPED WITH IT

(71) Applicant: ALPS ALPINE CO., LTD., Tokyo (JP)

(72) Inventors: Takaki Tanaka, Miyagi-ken (JP); Tatsuo Sugawara, Miyagi-ken (JP)

(73) Assignee: ALPS ALPINE CO., LTD., Tokyo (JP)

( * ) Notice: Subject to any disclaimer, the term of this patent is extended or adjusted under 35 U.S.C. 154(b) by 0 days.

(21) Appl. No.: 15/666,692

(22) Filed: Aug. 2, 2017

(65) Prior Publication Data

US 2018/0047529 A1 Feb. 15, 2018

(30) Foreign Application Priority Data

Aug. 10, 2016 (JP) ..... 2016-157437

(51) Int. Cl.

| | |
|---|---|
| ***H01H 13/52*** | (2006.01) |
| ***H01H 13/04*** | (2006.01) |
| ***H01H 13/14*** | (2006.01) |
| ***H01H 13/20*** | (2006.01) |
| ***H01H 1/58*** | (2006.01) |
| ***H01H 9/04*** | (2006.01) |
| ***H01H 13/06*** | (2006.01) |
| ***H01H 13/10*** | (2006.01) |
| ***H01H 13/18*** | (2006.01) |

(52) U.S. Cl.

CPC ..... *H01H 13/52* (2013.01); *H01H 1/5805* (2013.01); *H01H 9/04* (2013.01); *H01H 13/04* (2013.01); *H01H 13/063* (2013.01); *H01H 13/10* (2013.01); *H01H 13/14* (2013.01); *H01H 13/183* (2013.01); *H01H 13/20* (2013.01); *H01H 2009/048* (2013.01); *H01H 2235/01* (2013.01)

(58) Field of Classification Search

CPC ..... H01H 71/04; H01H 15/06; H01H 13/14; H01H 1/36; H01H 1/58; H01H 13/12; H01H 15/18; H01H 1/365; H01H 23/12; H02B 11/10; H02B 11/127

USPC ..... 200/33, 531, 536, 541, 547, 549, 550, 200/571, 252, 302.1, 302.2, 275, 293

See application file for complete search history.

(56) References Cited

U.S. PATENT DOCUMENTS 4,072,834 A * 2/1978 Godfrey ..... H01H 1/36 200/16 C
4,636,598 A * 1/1987 Suzuki ..... H01H 9/02 200/284

(Continued)

FOREIGN PATENT DOCUMENTS

| | | |
|---|---|---|
| DE | 195 10 491 A1 | 10/1996 |
| EP | 0 708 465 A2 | 4/1996 |
| EP | 2 685 483 A1 | 1/2014 |

(Continued)

*Primary Examiner* — Ahmed M Saeed

(74) *Attorney, Agent, or Firm* — Brinks Gilson & Lione

(57) ABSTRACT

First guide supports and second guide supports are integrally formed on an external base material to which external terminals are fixed. Guide protrusions and guide concave parts, which extend vertically, are formed on the housing of a switch device. When each guide protrusion and its corresponding guide concave part are guided by a first guide support and a second guide support during the attachment of the switch device to the external base material, the switch device can be easily attached.

17 Claims, 15 Drawing Sheets

(56) References Cited

U.S. PATENT DOCUMENTS

| | | | |
|---|---|---|---|
| 6,109,298 | A | 8/2000 | Kaneko et al. |
| 2014/0151213 | A1 | 6/2014 | Watanabe |

FOREIGN PATENT DOCUMENTS

| | | | |
|---|---|---|---|
| JP | 2004-253194 | A | 9/2004 |
| JP | 2011-146257 | A | 7/2011 |
| JP | 2013-225423 | A | 10/2013 |
| KR | 1998-079913 | A | 11/1998 |

* cited by examiner

SWITCH DEVICE AND DETECTING APPARATUS EQUIPPED WITH IT

CLAIM OF PRIORITY

This application claims benefit of priority to Japanese Patent Application No. 2016-157437 filed on Aug. 10, 2016, which is hereby incorporated by reference in its entirety.

BACKGROUND

1. Field of the Disclosure

The present disclosure relates to a switch device attached to an external base material having external terminals and to a detecting apparatus in which the switch device is attached to the external base material.

2. Description of the Related Art

Japanese Unexamined Patent Application Publication No. 2004-253194 describes an invention related to a switch device used in, for example, a door of an automobile.

In this switch device, a manipulation body is provided outside the housing of the switch device and a movable contact is provided in the housing so as to be operated by the manipulation body. Two terminal plates are included in the housing. On each terminal plate, a contact that comes into contact with the movable contact and a touching part that comes into contact with an external terminal are formed.

A pair of external terminals protrude from a mounting member to which the switch device is attached. A pair of mounting legs are formed integrally on the mounting member so as to protrude in parallel to the external terminals. When the switch device is attached to the mounting member, the mounting legs abut both sides of the housing almost at the same time as when the external terminals are inserted into the interior of the housing. When the switch device is pushed toward the mounting member in this state, each external terminal comes into contact with the touching part of the relevant terminal plate and a hook provided at the top of each mounting leg is engaged to the upper surface of the housing, fixing the switch device.

The switch device described in Japanese Unexamined Patent Application Publication No. 2004-253194 lacks a guide structure between the housing and the mounting member to which the housing is attached. If the mounting member has a wide space in an area in which the switch device is attached, there is no problem. If the switch device has to be attached in a narrow area, however, attachment work may become complex.

SUMMARY

In a switch device that has a housing, at least two internal terminals provided in the housing, a movable contact, and a manipulation body that operates the movable contact. An opening into which an external terminal can be inserted is formed in the housing. Each internal terminal has a contact touching part that is electrically connected to the movable contact and also has a terminal connecting part connectable to the external terminal inserted into the housing. The housing has at least one of a guide concave part and a guide protrusion that extend in a direction in which the external terminal is inserted.

With the above-described switch device, the housing may have a bottom part facing the attachment surface of an external base material to which the external terminal is fixed and may also have two side parts erected from the attachment surface with the bottom part intervening therebetween.

The opening may be formed in the bottom part. Each of the two side parts may have at least one of the guide concave part and guide protrusion.

Also, a detecting apparatus includes a positioning support and a guide support are provided on an external base material to which at least two external terminals are fixed, the guide support extending in the direction in which the external terminals extend. The switch device described above is disposed on the external base material, at least one of the guide concave part and guide protrusion is guided by the guide support, the housing is positioned by fitting the positioning structure and positioning support to each other, and the external terminals enter the interior of the housing from the opening and are connected to the terminal connecting parts.

DESCRIPTION OF THE EXEMPLARY EMBODIMENTS

Figure 1:
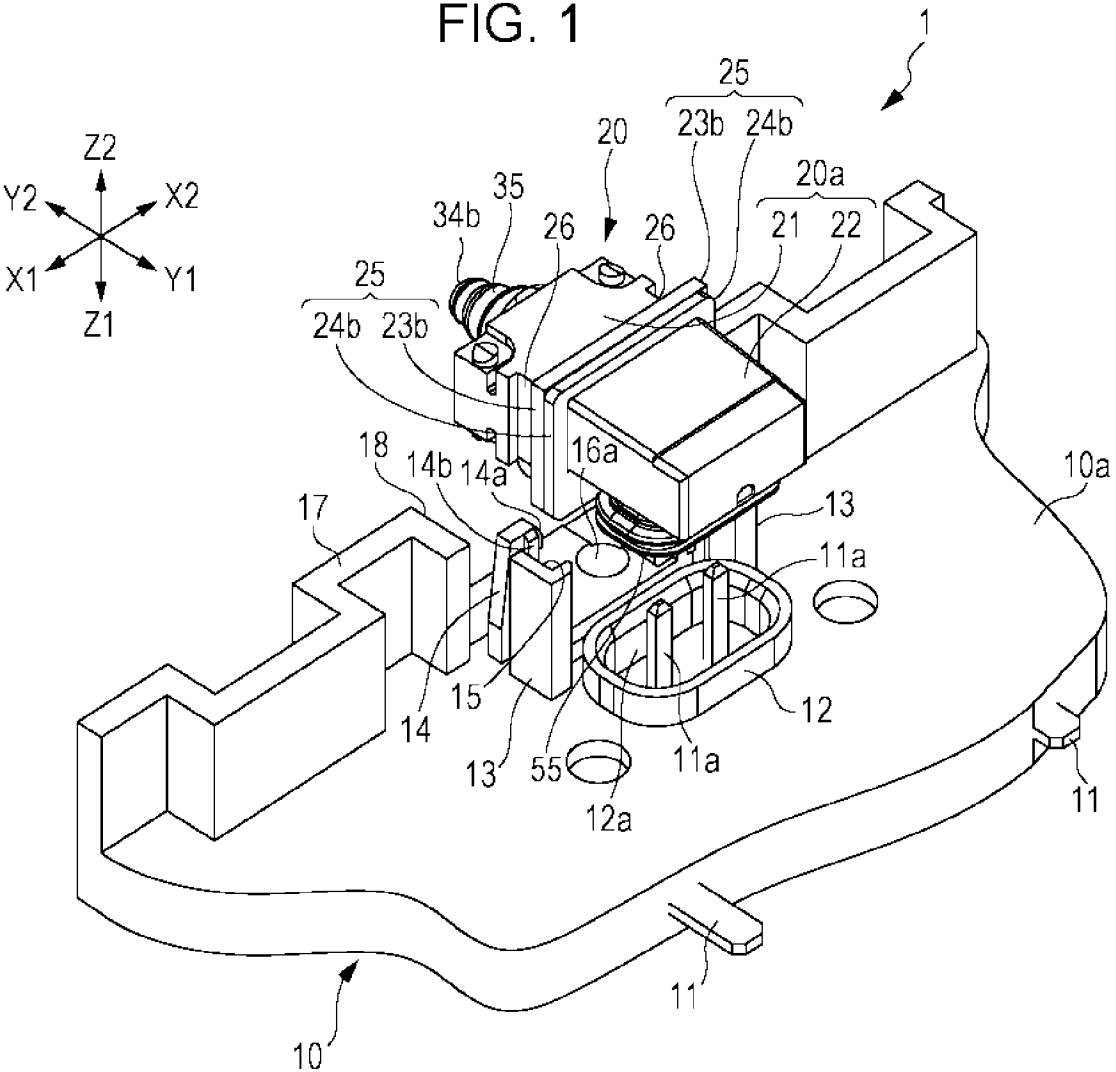
FIG. 1 is a perspective view illustrating a process to attach a switch device to an external base material in a detecting apparatus in a first embodiment of the present invention.
Figure 2:
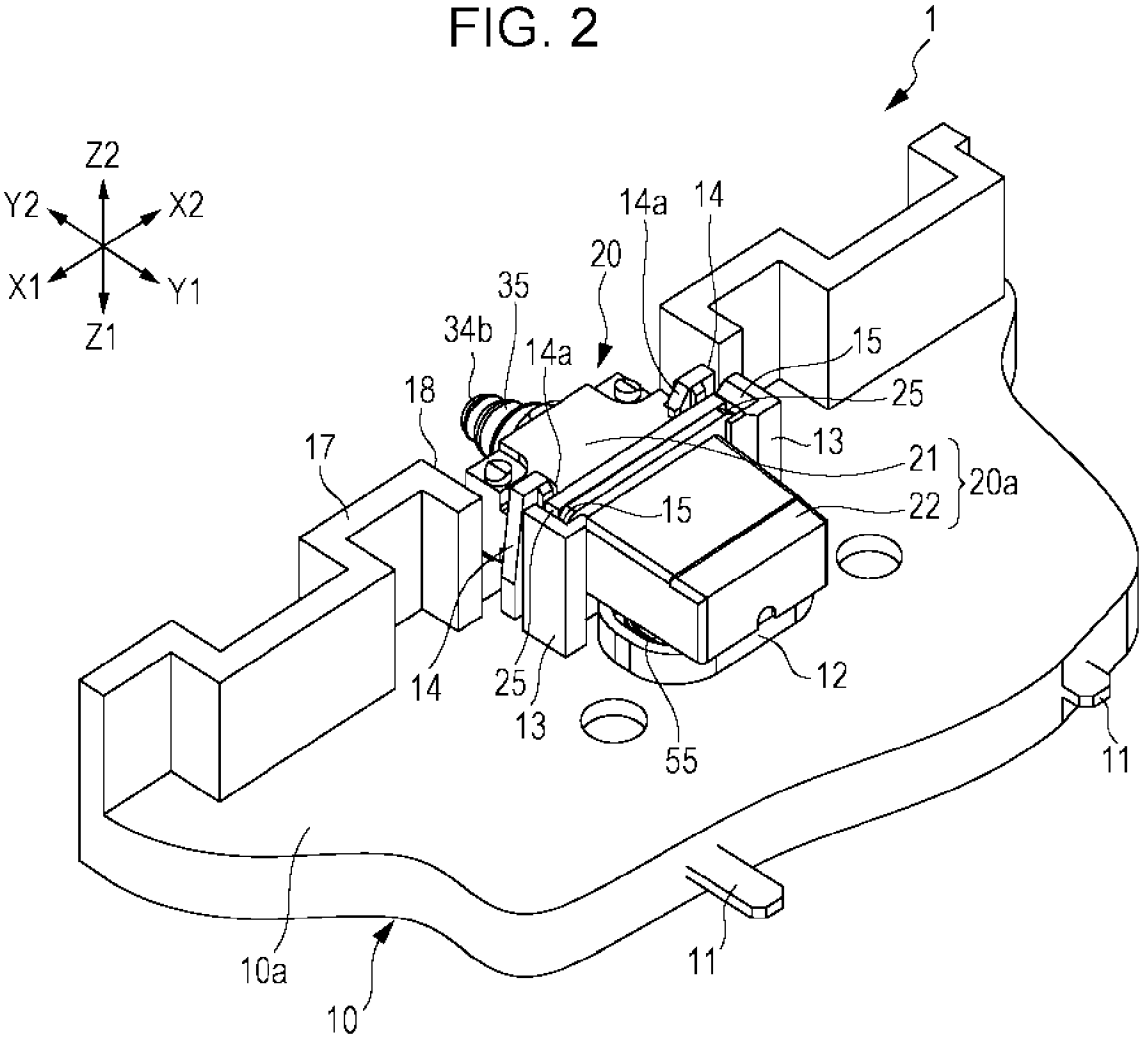
FIG. 2 is a perspective view illustrating a state in which, in the detecting apparatus in the first embodiment of the present invention, the switch device has been attached to the external base material.

A detecting apparatus 1, illustrated in FIGS. 1 and 2, in a first embodiment includes an external base material 10 and a switch device 20 attached to the external base material 10. The external base material 10 is, for example, part of a door of an automobile. The switch device 20 detects, for example, whether the door is open or closed and whether the door is locked or unlocked. However, the external base material 10 is not limited to part of a door of an automobile.

The detecting apparatus 1 illustrated in FIGS. 1 and 2 will take the X1-X2 direction as the right-and-left direction, the Y1-Y2 direction as the front-and-back direction, and the Z1-Z2 direction as the vertical direction.

The external base material 10 is made of a synthetic resin material. A pair of conductive plates 11 made of copper, a copper alloy, or the like are buried in the external base material 10. Part of each conductive plate 11 is erected perpendicularly from an attachment surface 10*a* in the Z2 direction, the attachment surface 10*a* being the upper surface of the external base material 10, the attachment surface 10*a* facing in the Z2 direction. The erected part is an external terminal 11*a*.

Figure 3:
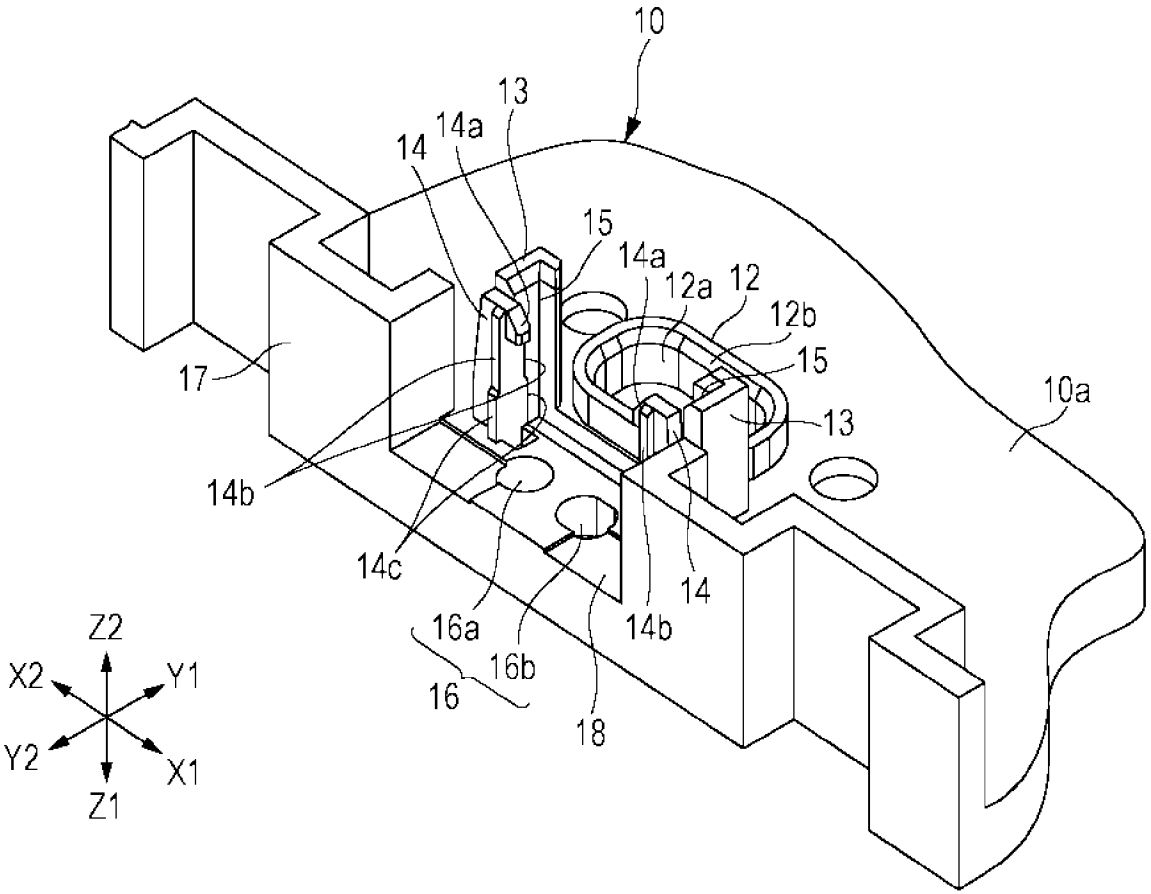
FIG. 3 is a partial perspective view illustrating the external base material of the detecting apparatus in the first embodiment of the present invention.

The external base material 10 in FIG. 3 is illustrated as viewed from the front with the conductive plates 11 eliminated.

As illustrated in FIGS. 1 and 2, a tube 12 extending from the attachment surface 10*a* of the external base material 10 is integrally formed. The inner surface of the tube 12 forms a wall surface 12*a*, which encloses a pair of external terminals 11*a*. The wall surface 12*a* is ellipsoidala in a plan view. A concave part may be formed in the external base material 10, and the inner surface of the concave part may be the wall surface 12*a*.

The external base material 10 has a pair of first guide supports 13 and a pair of second guide supports 14, which are disposed closer to the front (Y2 side) than the tube 12 is. Each first guide support 13 and each second guide support 14 are formed integrally with the external base material 10 so as to be erected upward perpendicularly (in the Z2 direction) from the attachment surface 10*a*.

The pair of first guide supports 13 are disposed with a spacing left between them in the right-and-left direction (X1-X2 direction), and the pair of second guide supports 14 are also are disposed with a spacing left between them in the right-and-left direction. A guide support concave part 15, which extends in the vertical direction, is formed between the first guide support 13 on the X1 side and the relevant second guide support 14. Another guide support concave part 15 is also formed similarly on the X2 side. The guide support concave part 15 on the X1 side and the guide support concave part 15 on the X2 side are formed so that their concave parts face each other.

Each second guide support 14 functions as a guide support protrusion. As illustrated in FIG. 3, each second guide support (second guide support protrusion) 14 integrally has a hook 14*a* on the upper end so as to face in the Z2 direction. The hook 14*a* of the second guide support 14 disposed on the X1 side and the hook 14*a* of the second guide support 14 disposed on the X2 side protrude so as to face each other. A guide rib 14*b* extending vertically (in the Z1-Z2 direction) is formed on a side, of each second guide support 14, that faces in the Y1 direction, and another guide rib 14*b* is similarly formed on a side that faces in the Y2 direction. The lower part of each guide rib 14*b* is a wide-width part 14*c* having a large width dimension in the front-and-back direction.

As illustrated in FIG. 3, a positioning support 16 is provided on the attachment surface 10*a* of the external base material 10 between the pair of second guide supports 14 disposed in the right-and-left direction and closer to the front (Y2 side) than the second guide supports 14 are. The positioning support 16 is composed of paired positioning concave parts 16*a* and 16*b*. The positioning concave part 16*a* is a perfectly circular hole. The opening of the positioning concave part 16*b* is formed so that the width in the front-and-back direction (Y1-Y2 direction) matches the inner diameter dimension of the positioning concave part 16*a* in a perfectly circular shape. However, the positioning concave part 16*b* is slightly longer than the positioning concave part 16*a* in the right-and-left direction (X1-X2 direction).

A wall 17 is formed at the front (Y2 side) of the external base material 10. The wall 17 has a concave part 18 so that the switch device 20 is exposed toward the front (in the Y2 direction).

Figure 4:
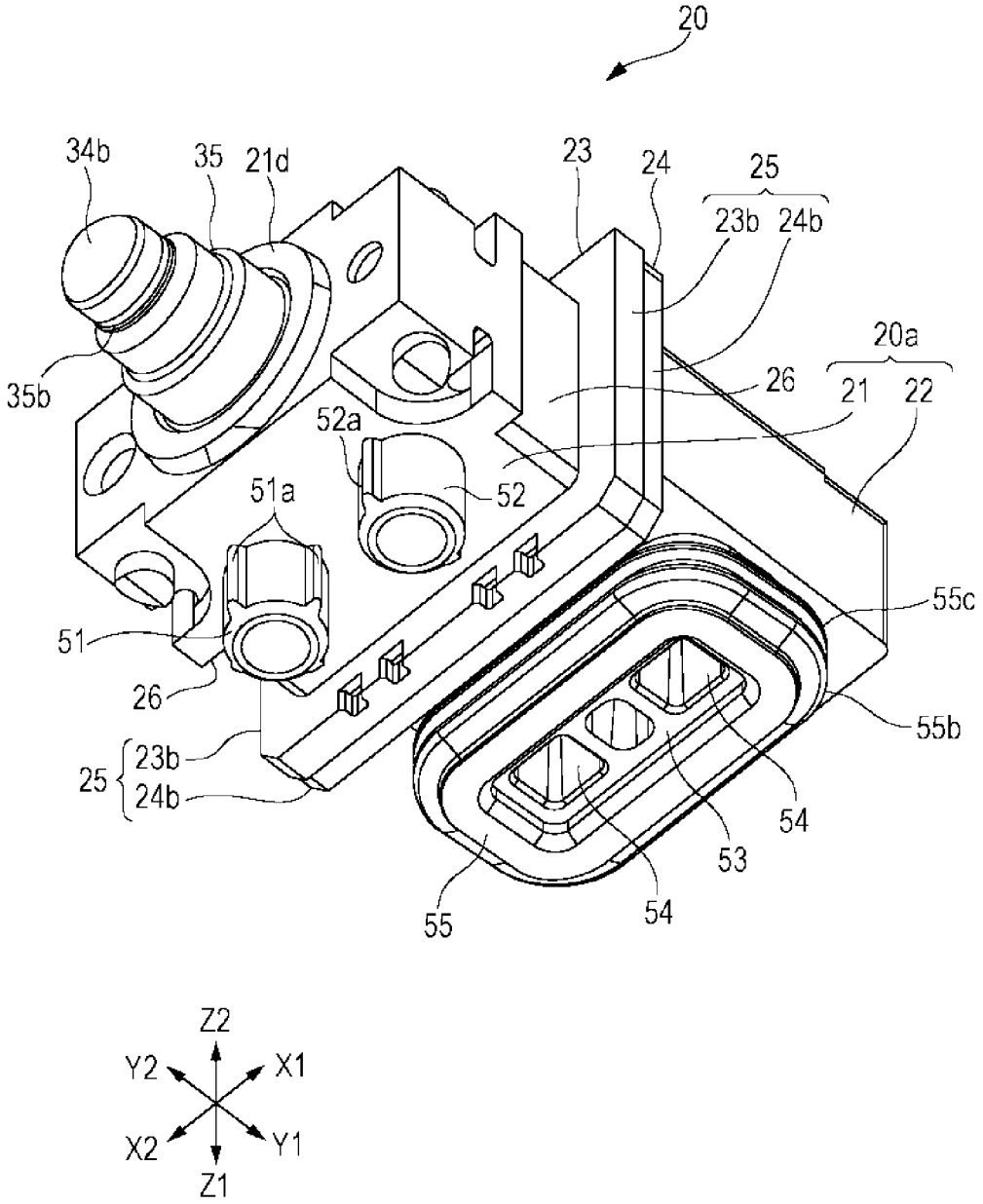
FIG. 4 is a perspective view of the switch device in the first embodiment of the present invention, as viewed from the bottom part of the housing of the switch device.
Figure 5:
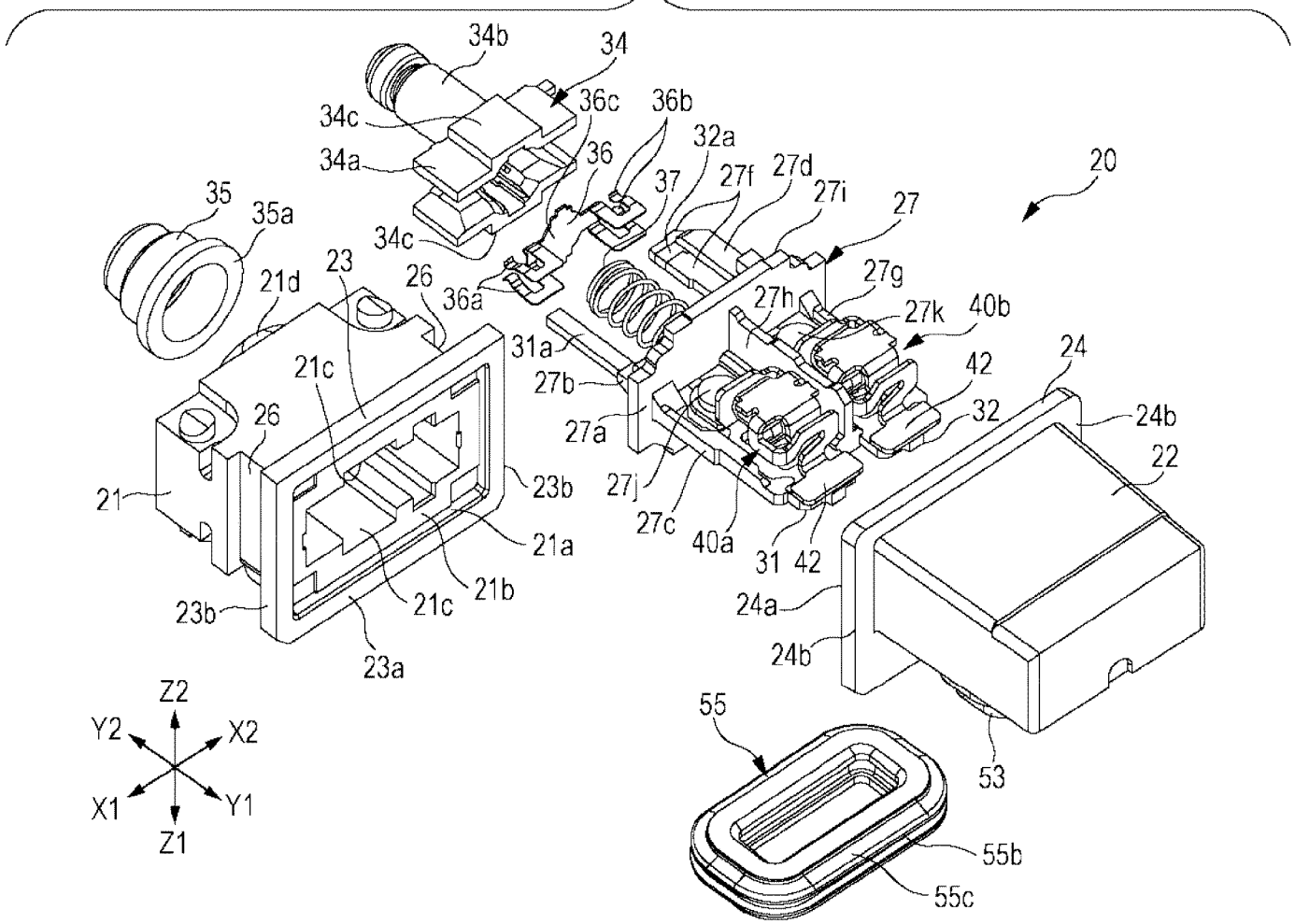
FIG. 5 is an exploded perspective view illustrating the switch device in the first embodiment of the present invention.

FIG. 4 is a perspective view of the switch device 20, as viewed from below on the front side. FIG. 5 is an exploded perspective view of the switch device 20, as viewed in the same direction as in FIGS. 1 and 2.

The housing 20*a* of the switch device 20 is formed by combining a first case 21 and a second case 22. The first case 21 and second case 22 are made of a synthetic resin material such as polybutylene terephthalate (PBT) or the like. The first case 21 is disposed at the front (in the Y2 direction), and the second case 22 is disposed at the back (in the Y1 direction).

As illustrated in FIGS. 4 and 5, a flange 23 is integrally formed at the back end of the first case 21. The flange 23 is formed so as to protrude from an outer surface of the first case 21 in the right-and-left direction (X1-X2 direction) and in the vertical direction (Z1-Z2 direction). The outside shape of the flange 23 is rectangular. A flange 24 is integrally formed at the front end of the second case 22. The flange 24 is formed so as to protrude from an outer surface of the second case 22 in the right-and-left direction (X1-X2 direction) and in the vertical direction (Z1-Z2 direction). The outside shape of the flange 24 is rectangular.

A joint surface 23*a* is formed on the flange 23 of the first case 21 so as to face backward (in the Y1 direction). A joint surface 24*a* is formed on the flange 24 of the second case 22 so as to face forward (in the Y2 direction). As illustrated in FIG. 4, the flange 23 and flange 24 are bonded together and are fixed by, for example, laser welding in a state in which the joint surface 23*a* and joint surface 24*a* are combined together face to face, so that the first case 21 and second case 22 are fixed to each other. This forms the housing 20*a* of the switch device 20. Preferably, the flange 23 and flange 24 are bonded together continuously by laser welding along their outer circumferences and are fixed to each other so that water droplets and the like do not enter the interior.

As illustrated in FIG. 4, a guide protrusion 25 is formed by a joint part between a flange side 23*b* that extends toward the X1 side, the flange side 23*b* being part of the flange 23 of the first case 21 and a flange side 24*b* that extends toward the X1 side, the flange side 24*b* being part of the flange 24 of the second case 22. Another guide protrusion 25 is similarly formed by a joint part between a flange side 23*b* that extends toward the X2 side and a flange side 24*b* that extends toward the X2 side. One guide protrusion 25 protrudes from the housing 20*a* toward the X1 side and extends. Another guide protrusion 25 protrudes from the housing 20*a* toward the X2 side and extends vertically (in the Z1-Z2 direction). That is, the housing 20*a* of the switch device 20 has a side facing in the X1 direction and a side facing in the X2 direction, and each guide protrusion 25 is provided so that these side extend vertically (in the Z1-Z2 direction).

As illustrated in FIGS. 4 and 5, a guide concave part 26 is formed in a side of the first case 21, the side facing in the X1 direction, and another guide concave part 26 is formed in another side of the first case 21, the other side facing in the X2 direction. Each guide concave part 26 continuously extends vertically (in the Z1-Z2 direction) on the side of the housing 20*a* on the X1 or X2 side, whichever is appropriate. The width dimension of the opening of the each guide concave part 26 in the front-and-back direction (Y1-Y2 direction) is uniform over the entire length.

The Z1-Z2 direction, in which the guide protrusion 25 and guide concave part 26 extend, is a direction in which the switch device 20 is attached to the external base material 10 and is also a direction in which the external terminal 11*a* protrudes from the external base material 10.

The guide protrusion 25 and guide concave part 26 form a guide means used when the switch device 20 is attached to the attachment surface 10*a* of the external base material 10. The guide concave part 26 may be formed on the second case 22. Although only one of the guide protrusion 25 and guide concave part 26 may be provided, both the guide protrusion 25 and the guide concave part 26 are preferably provided as in this embodiment.

As illustrated in FIG. 5, a terminal holding member 27 is accommodated in the housing 20*a* of the switch device 20. The terminal holding member 27 is made of the same synthetic resin material as the first case 21 and second case 22.

Figure 6:
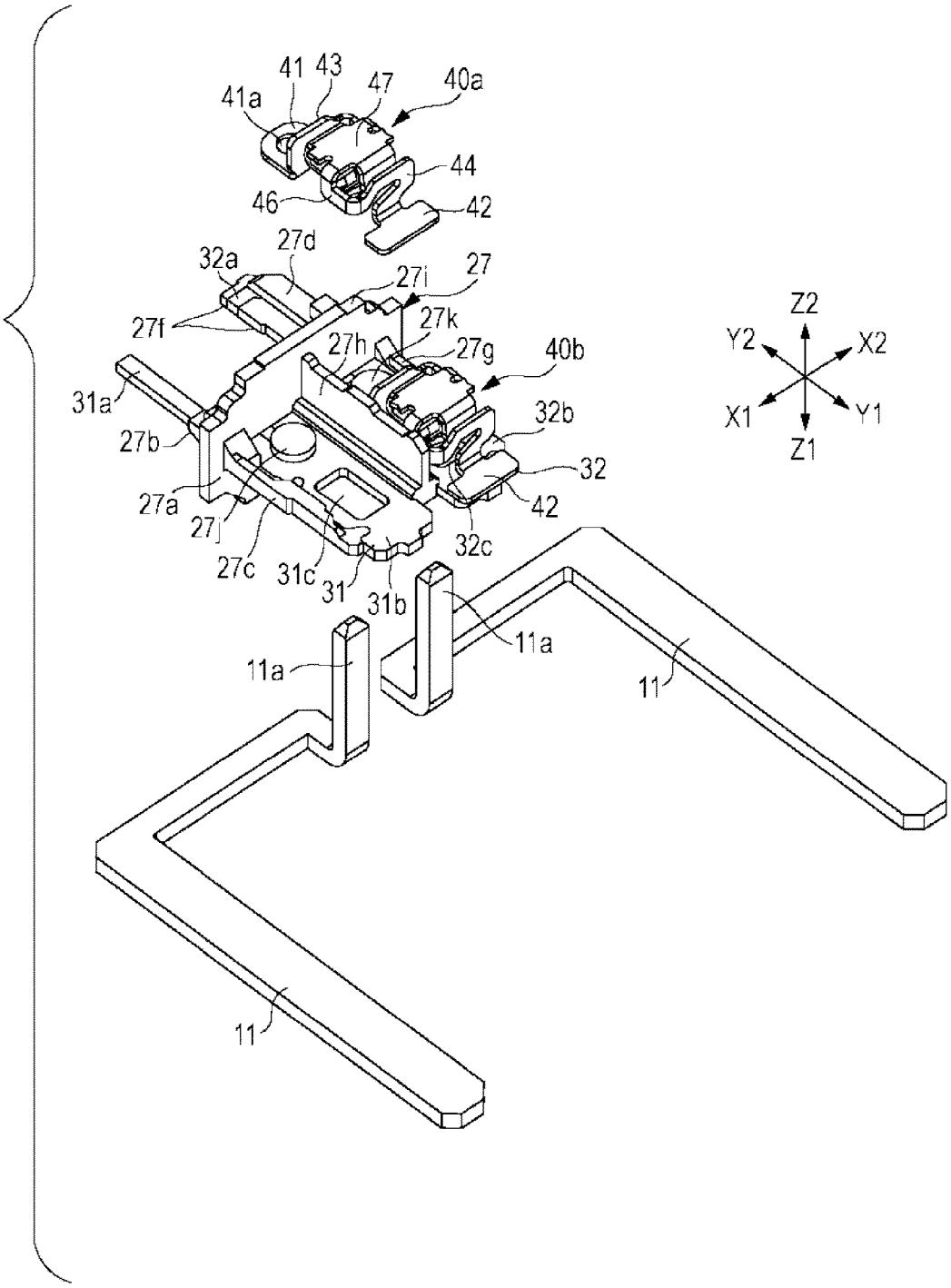
FIG. 6 is a partially exploded perspective view illustrating the internal terminals, terminal connection parts, and external terminals of the switch device in the first embodiment of the present invention.

As illustrated in FIGS. 5 and 6, a first internal terminal 31 and a second internal terminal 32 are preferably held by the terminal holding member 27. The first internal terminal 31 and second internal terminal 32 are made of a conductive metal plate such as, for example, a phosphor bronze plate. The terminal holding member 27 is formed by a so-called insert molding method in which a synthetic resin material is injected in a state in which the first internal terminal 31 and second internal terminal 32 are held.

As illustrated in FIGS. 5 and 6, the terminal holding member 27 has a positioning wall 27*a* parallel to the X-Z plane. At positions closer to the front (Y2 side) than the positioning wall 27*a* is, a contact-side holding part 27*b* is integrally formed on the X1 side, and a contact-side holding part 27*d* is integrally formed on the X2 side. At positions closer to the back (Y1 side) than the positioning wall 27*a* is, a connection-side holding part 27*c* is integrally formed on the X1 side, and a connection-side holding part 27*g* is integrally formed on the X2 side.

The first internal terminal 31 is disposed so as to pass through the positioning wall 27*a* in the front-and-back direction. The first internal terminal 31 is held by the contact-side holding part 27*b* on the front side and is held by the connection-side holding part 27*c* on the back side. The second internal terminal 32 is disposed so as to pass through the positioning wall 27*a* in the front-and-back direction. The second internal terminal 32 is held by the contact-side holding part 27*d* on the front side and is held by the connection-side holding part 27*g* on the back side. Preferably, a partition wall 27*h* is integrally formed as part of the terminal holding member 27 so as to extend from the positioning wall 27*a* toward the back. The partition wall 27*h* is formed between the first internal terminal 31 and the second internal terminal 32 so as to be erected upward in parallel to the Y-Z plane. The partition wall 27*h* preferably separates the first internal terminal 31 and second internal terminal 32 from each other.

As illustrated in FIG. 5, a concave part 21*a* is formed at the back end of the first case 21 so as to be enclosed by the flange 23. The internal bottom surface, facing the back (in the Y1 direction), of the concave part 21*a* is an abutting surface 21*b*.

Figure 13:
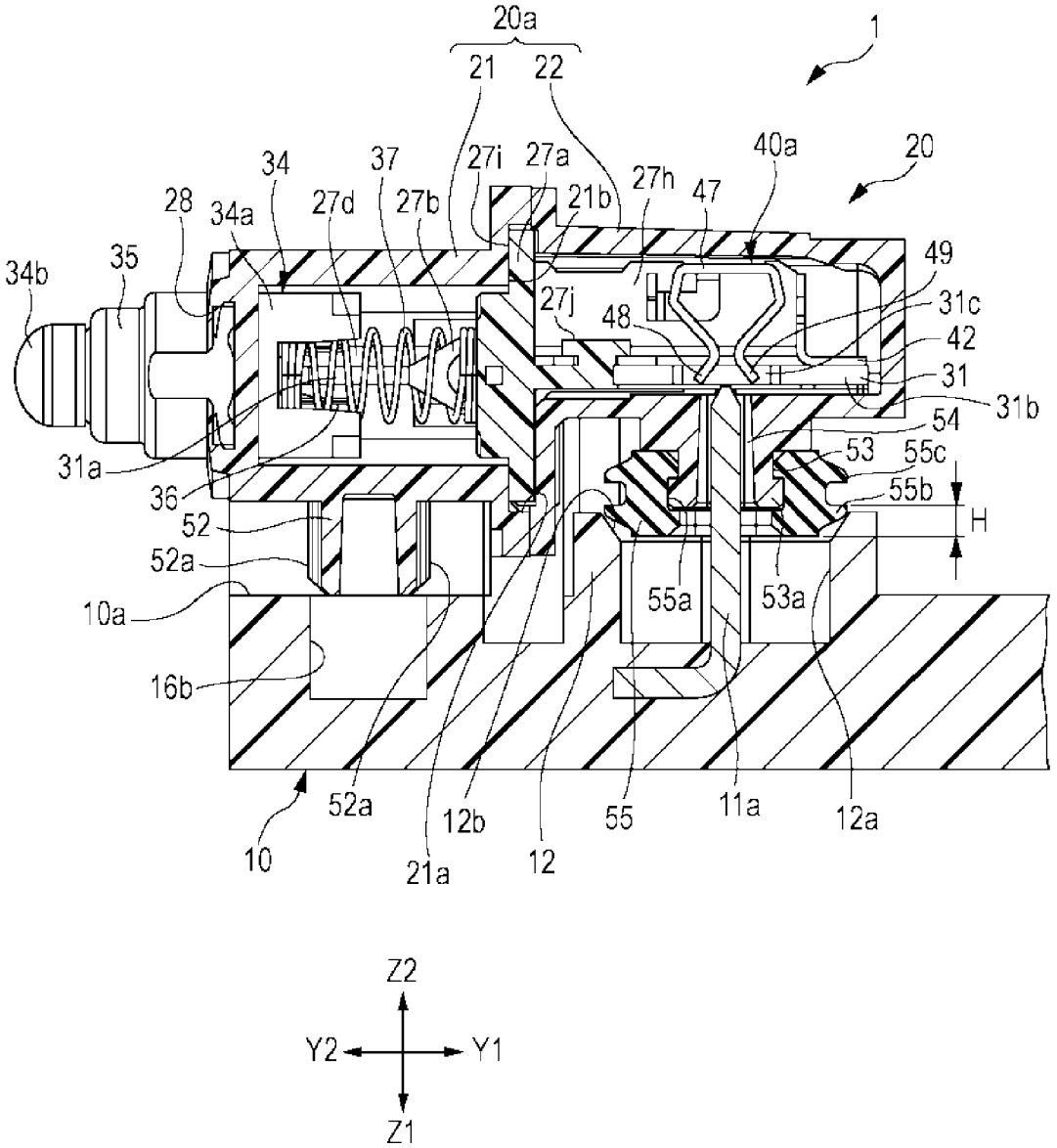
FIG. 13 is a cross-sectional view of the switch device in the process in FIG. 11.

FIG. 13 is a cross-sectional view of the assembled switch device 20. The contact-side holding parts 27*b* and 27*d* of the terminal holding member 27 and the front parts of the first internal terminal 31 and second internal terminal 32, which are respectively held by the contact-side holding parts 27*b* and 27*d*, are inserted into the internal space of the first case 21. The front surface 27*i* of the positioning wall 27*a* abuts the butting surface 21*b*. In the concave part 21*a*, the positioning wall 27*a* is positioned and held so as not to move in the right-and-left direction (X1-X2 direction) and in the vertical direction (Z1-Z2 direction). The connection-side holding parts 27*c* and 27*g* of the terminal holding member 27 and the back parts of the first internal terminal 31 and second internal terminal 32, which are respectively held by the connection-side holding parts 27*c* and 27*g*, are inserted into the internal space of the second case 22. The first case 21 and second case 22 are fixed to each other with the positioning wall 27*a* interposed between the first case 21 and the second case 22.

When the front surface 27*i* of the positioning wall 27*a* of the terminal holding member 27 abuts the butting surface 21*b* of the first case 21, the first case 21 and terminal holding member 27 are preferably positioned. Alternatively, when the positioning wall 27*a* is interposed between the first case 21 and the second case 22, the terminal holding member 27 is positioned with respect to both the first case 21 and the second case 22. Alternatively, the positioning wall 27*a* may be fixed to at least one of the first case 21 and second case 22 by, for example, laser welding.

A manipulation body 34 is accommodated in the first case 21 so as to be freely operated. The manipulation body 34 is made of a synthetic resin material. As illustrated in FIG. 5, the manipulation body 34 has a slider 34*a* and a manipulation axis 34*b*, which extends from the slider 34*a* toward the front, the slider 34*a* and manipulation axis 34*b* being formed integrally with each other. Sliding protrusions 34*c*, each of which extends in the front-and-back direction, are formed on the upper surface and lower surface of the slider 34*a*, one on each surface. Guide grooves 21*c* extending in the front-and-back direction are formed in the upper and lower inner surfaces of the first case 21, one in each inner surface. Each sliding protrusion 34*c* is slidably inserted into the relevant guide groove 21*c*. Accordingly, the manipulation body 34 is supported in the first case 21 so as to be movable in the front-and-back direction.

As illustrated in FIG. 13, a slide hole 28 is formed at the front of the first case 21 so as to pass through the first case 21 in the front-and-back direction. The manipulation axis 34*b* protrudes forward from the slide hole 28. A waterproof cover 35 is attached to the outer circumference of the manipulation axis 34*b* in front of the first case 21. The waterproof cover 35 is made of a water-resistant synthetic rubber material. As illustrated in FIGS. 4 and 5, a matching part 21*d* protrudes from the front surface of the first case 21. The back end 35*a* of the waterproof cover 35 is attached to the inside of the matching part 21*d*. A hole 35*b* formed at the front of the waterproof cover 35 is placed tightly around the front outer circumference of the manipulation axis 34*b*. The waterproof cover 35 shields a clearance between the manipulation axis 34*b* and the slide hole 28 from the outside. The elastic force of the waterproof cover 35 enables the manipulation body 34 to move in the first case 21 in the front-and-back direction.

As illustrated in FIG. 5, a movable contact 36 is held by the slider 34*a* of the manipulation body 34. The movable contact 36 is formed from a low-resistance metal plate with a high spring property (elastic coefficient) made of, for example, a phosphor bronze material or a Corson copper alloy (Cu-Ni-Si alloy). The movable contact 36 integrally has a pair of first sliding pieces 36*a* facing vertically on the X1 side and a pair of second sliding pieces 36*b* facing vertically on the X2 side.

As illustrated in FIGS. 5 and 13, in the first case 21, a return spring member 37 is provided between the central part 36*c* of the movable contact 36 and the positioning wall 27*a* of the terminal holding member 27. The return spring member 37 is a helical compression spring. Due to the elastic force of the return spring member 37, the manipulation body 34 is constantly urged forward (in the Y2 direction).

As illustrated in FIGS. 5 and 6, the first internal terminal 31 has a contact touching part 31*a*, which is exposed from the contact-side holding part 27*b* in a portion closer to the front (Y2 side) than the positioning wall 27*a* is. Most of the portion, of the second internal terminal 32, that protrudes forward from the positioning wall 27*a* is buried in the contact-side holding part 27*d*. The contact-side holding part 27*d* has an insulative sliding part 27*f* extending in the front-and-back direction with a fixed thickness. Part of the top of the second internal terminal 32 is exposed from the insulative sliding part 27*f*. The exposed part forms a contact touching part 32*a*. The first sliding pieces 36*a* of the movable contact 36 interpose the contact touching part 31*a* of the first internal terminal 31 vertically therebetween. The second sliding pieces 36*b* selectively interpose the insulative sliding part 27*f* and the contact touching part 32*a* of the second internal terminal 32 vertically therebetween.

When the manipulation body 34 has been moved forward (in the Y2 direction) by the return spring member 37, the first sliding pieces 36*a* of the movable contact 36 touch the contact touching part 31*a* and the second sliding pieces 36*b* touch the contact touching part 32*a*. This causes the first internal terminal 31 and second internal terminal 32 to be electrically connected. When the manipulation body 34 is pushed backward (in the Y1 direction) against the return force of the return spring member 37, the first sliding pieces 36*a* remain in contact with the contact touching part 31*a*, but the second sliding pieces 36*b* touch the insulative sliding part 27*f*. This causes the first internal terminal 31 and second internal terminal 32 to be electrically disconnected.

As illustrated in FIG. 6, the first internal terminal 31 has a connection support 31*b*, which protrudes backward (in the Y1 direction) from the positioning wall 27*a*. The connection support 31*b* has an insertion part 31*c*, which is a rectangular hole passing through the connection support 31*b* vertically. Similarly, the second internal terminal 32 has a connection support 32*b*, which protrudes backward from the positioning wall 27*a*. The connection support 32*b* has an insertion part 32*c*, which is a rectangular hole passing through the connection support 32*b* vertically.

As illustrated in FIGS. 5 and 6, a terminal connecting part 40*a* is fixed onto the connection support 31*b* of the first internal terminal 31, and a terminal connecting part 40*b* is fixed onto the connection support 32*b* of the second internal terminal 32. The terminal connecting part 40*a* and terminal connecting part 40*b* have the same structure and the same dimensions. The terminal connecting part 40*a* and terminal connecting part 40*b* are made of a plate material that is thinner and easier to warp than the first internal terminal 31 and second internal terminal 32, such as a phosphor bronze material, a Corson copper alloy, or another low-resistance metal material with a high spring property (elastic coefficient). The terminal connecting part 40*a* and terminal connecting part 40*b* may be made of the same type of metal material as the first internal terminal 31 and second internal terminal 32, or may be made of an appropriate combination of different metal materials.

Figure 7:
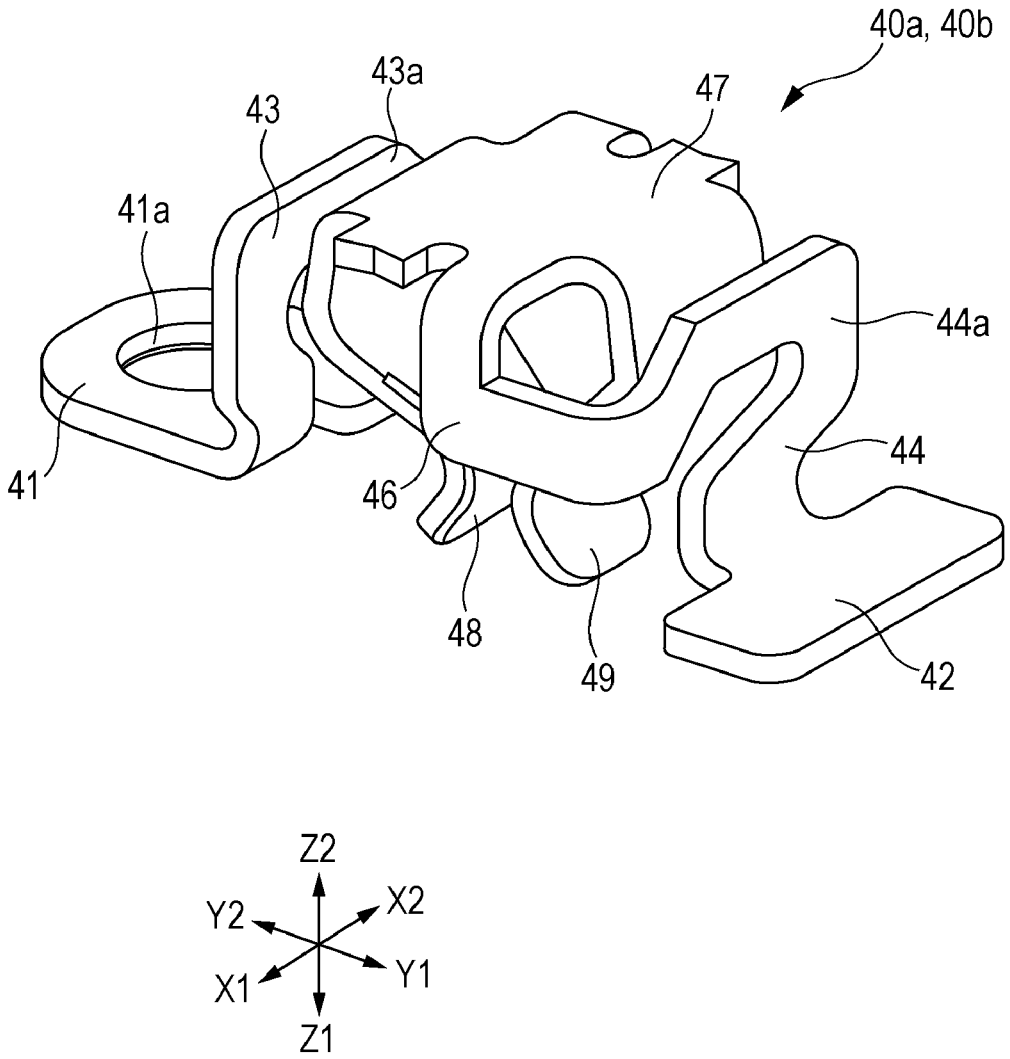
FIG. 7 is a perspective view of the terminal connection parts of the switch apparatus.
Figure 8A:
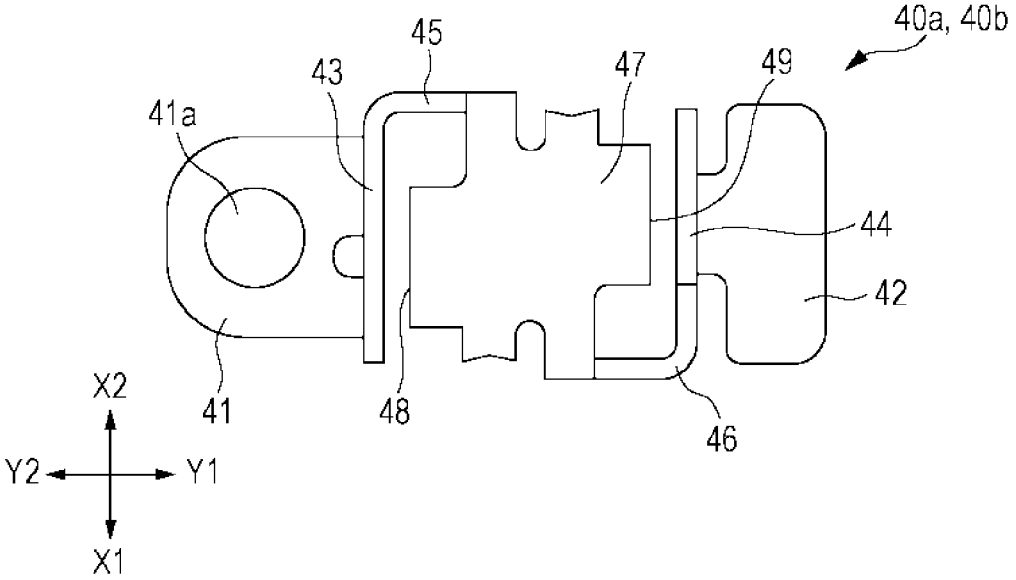
FIG. 8A is a plan view of the terminal connection parts.
Figure 8B:
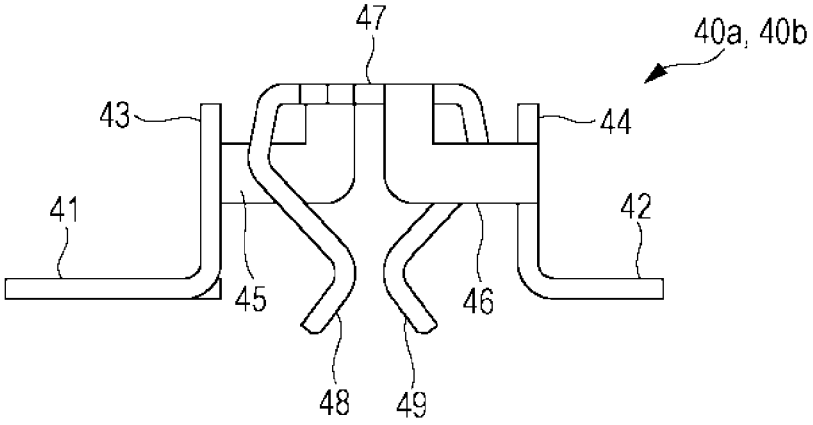
FIG. 8B is a side view of the terminal connection parts.

The terminal connecting parts 40*a* and 40*b* are enlarged in FIG. 7 and FIGS. 8A and 8B.

The terminal connecting parts 40*a* and 40*b* each have a first fixing part 41 and a second fixing part 42. The first fixing part (first fixing piece) 41 and second fixing part (second fixing piece) 42 are disposed with a spacing left between them in the front-and-back direction (Y1-Y2 direction). The first fixing part 41 has a fixing hole 41*a*.

A first support elastic piece 43 is formed so as to be bent upward from the first fixing part 41. A first support elastic piece 44 is formed so as to be bent upward from the second fixing part 42. The first support elastic piece 43 and first support elastic piece 44 face each other substantially in parallel with a spacing left between them in the front-and-back direction. The first support elastic piece 43 has a bent part 43*a*, and the first support elastic piece 44 has a bent part 44*a*. The bent parts 43*a* and 44*a* are curved substantially in a U-shape in a X-Z plane.

As illustrated in FIG. 7 and FIGS. 8A and 8B, a second support elastic piece 45, which is bent from the X2 side in the Y1 direction, is formed so as to be contiguous to the first support elastic piece 43, and a second support elastic piece 46, which is bent from the X1 side in the Y2 direction, is formed so as to be contiguous to the first support elastic piece 44. A contact base 47 is provided so as to be contiguous to the top of the second support elastic piece 45 and to the top of the second support elastic piece 46. The contact base 47 has a contact piece 48, on the Y2 side, that extends downward and is bent, and also has a contact piece 49, on the Y1 side, that extends downward is bent, the contact pieces 48 and 49 being paired.

As illustrated in FIG. 6, the connection support 31*b* of the first internal terminal 31 has a hole at a position closer to the front than the insertion part 31*c* is. Part of the synthetic resin material that forms the terminal holding member 27 protrudes upward from this hole, forming a fixing protrusion 27*j*. In the attachment of the terminal connecting part 40*a* onto the connection support 31*b* of the first internal terminal 31, the fixing protrusion 27*j* is inserted into the fixing hole 41*a* in the first fixing part 41, after which the top of the fixing protrusion 27*j* is heated and crushed to form a so-called thermal caulking structure. Then, the terminal connecting part 40*a* is fixed. The fixing protrusion 27*j* illustrated in FIG. 6 has the same size and the same thickness as the one that has been thermally caulked.

After the thermal caulking structure has been formed, a portion at which the second fixing part 42 of the terminal connecting part 40*a* is placed on the connection support 31*b* is illuminated by a laser beam to spot-weld the connection support 31*b* and second fixing part 42 together and fix them to each other. This can enhance the reliability of the electrical connection between the first internal terminal 31 and the terminal connecting part 40*a*. Welding may be resistance welding. For example, spot-welding may be performed at a plurality of points in the X1-X2 direction in FIG. 6. When spot-welding is performed at a plurality of points, the reliability of the electrical connection can be further enhanced.

The terminal holding member 27 also has another fixing protrusion 27*k* formed at a portion at which the connection support 32*b* of the second internal terminal 32 is held. When the terminal connecting part 40*b* is be mounted on the connection support 32*b*, the fixing protrusion 27*k* is inserted into the fixing hole 41*a* in the first fixing part 41 of the terminal connecting part 40*b* and a thermal caulking structure is formed, in the same way as described above. The connection support 32*b* and the second fixing part 42 of the terminal connecting part 40*b* are spot-welded together to make an electrical connection between the second internal terminal 32 and the terminal connecting part 40*b*.

Figure 14:
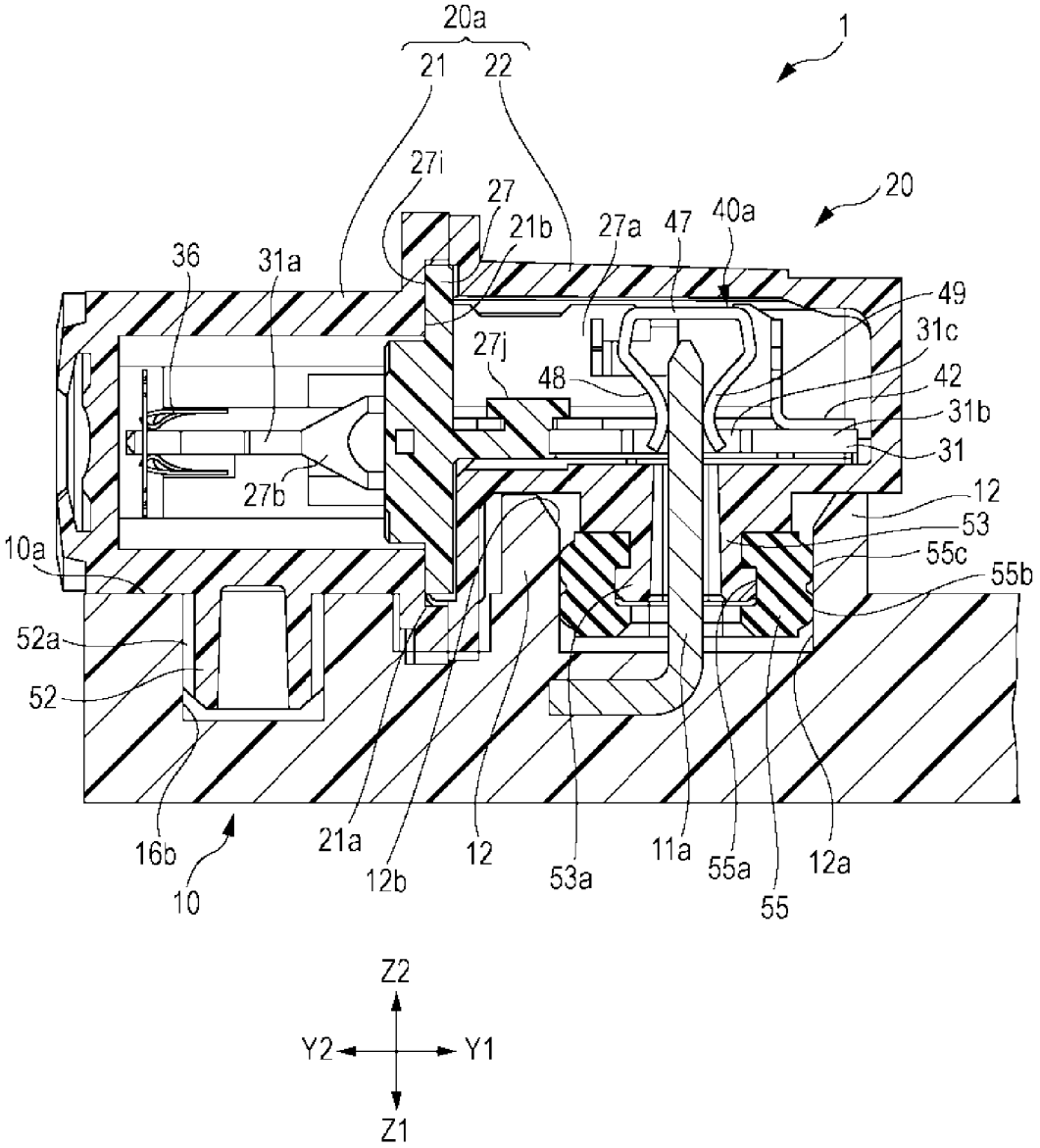
FIG. 14 is a cross-sectional view of the switch device in the process in FIG. 12.

As illustrated in FIGS. 13 and 14, after the terminal connecting part 40*a* has been fixed onto the connection support 31*b* of the first internal terminal 31, the paired contact pieces 48 and 49 formed as part of the terminal connecting part 40*a* are positioned above the insertion part 31*c* with their lower ends inserted into the interior of the insertion part 31*c* formed in the connection support 31*b*. Similarly, the paired contact pieces 48 and 49 formed as part of the terminal connecting part 40*b* are positioned above the insertion part 32*c* with their lower ends inserted into the interior of the insertion part 32*c* formed in the connection support 32*b*.

FIG. 4 illustrates the switch device 20 viewed from below.

Preferably, a pair of positioning bosses 51 and 52 are integrally formed on the bottom part of the first case 21. The pair of positioning bosses 51 and 52 form a positioning structure. The positioning bosses 51 and 52 are in a cylindrical shape and have the same diameter. On the outer circumferential surface of the positioning boss 51, pressure contact ribs 51*a* extending vertically (in the Z1-Z2 direction) are integrally formed at a plurality of points. Similarly, on the outer circumferential surface of the positioning boss 52, pressure contact ribs 52*a* are integrally formed at a plurality of points.

As illustrated in FIGS. 4 and 13, preferably, a fitting protrusion 53 protruding downward is integrally formed at the bottom part of the second case 22. The fitting protrusion 53 is formed in an area elongated in the X1-X2 direction. A pair of openings 54 are preferably formed in the fitting protrusion 53. As illustrated in FIG. 13, each opening 54 communicates with the internal space of the second case 22.

In the interior of the second case 22, each of the insertion part 31*c* formed in the connection support 31*b* of the first internal terminal 31, and the insertion part 32*c* formed in the connection support 32*b* of the second internal terminal 32 faces the relevant opening 54.

As illustrated in FIG. 4, a sealing member 55 is preferably attached to the circumference of the fitting protrusion 53 disposed at the bottom part of the second case 22. The sealing member 55 is made of a waterproof synthetic rubber material. As illustrated in FIG. 13, a flange 53*a*, which protrudes toward the outer circumference of the fitting protrusion 53, is provided at its lower end. A fitting concave part 55*a* is circumferentially formed along the inner surface of the sealing member 55. When the fitting concave part 55*a* is fitted to the flange 53*a*, the sealing member 55 is attached in such a way that the sealing member 55 does not easily come off the fitting protrusion 53.

A lower elongated protrusion 55*b* and an upper elongated protrusion 55*c* are formed integrally with each other on the outer circumferential surface of the sealing member 55. The lower elongated protrusion 55*b* and upper elongated protrusion 55*c* are formed along the entire circumference of the sealing member 55. As illustrated in FIG. 13, when the sealing member 55 is attached to the fitting protrusion 53, a lower portion, with a height of H, of the sealing member 55 further protrudes downward relative to the lower end of the fitting protrusion 53. At least part of the lower elongated protrusion 55*b* is formed in an area indicated by the height H.

The shape of the sealing member 55 is vertically symmetric in the Z1-Z2 direction. Therefore, even if any side of the sealing member 55 in the vertical direction is oriented upward or downward during assembling, the sealing member 55 can be attached normally.

Next, processes to attach the switch device 20 in the detecting apparatus 1 and the operation of the detecting apparatus 1 will be described.

FIGS. 9 to 12 illustrate processes to attach the switch device 20 to the external base material 10.

The switch device 20 is attached to the attachment surface 10*a* of the external base material 10 in the Z1 direction. With the switch device 20, the positioning bosses 51 and 52, which function as a positioning structure, are formed at the bottom part of the first case 21, and the openings 54, which lead the pair of external terminals 11*a* to the interior of the housing 20*a*, are also formed at the bottom part of the second case 22. It is difficult to check the positioning bosses 51 and 52 and the openings 54 by viewing them from above the switch device 20.

Since the guide protrusion 25 and guide concave part 26 are provided on the sides of the housing 20*a* on both the X1 and X2 sides, however, when the switch device 20 is viewed from above (from the Z2 side), the guide protrusion 25 and guide concave part 26 can be checked from above. The pair of first guide supports 13 and the pair of second guide supports 14, disposed on the external base material 10, can also be easily checked from above. Therefore, in the incorporation of the switch device 20 into a limited space on the external base material 10 as illustrated in FIG. 1, when the guide protrusion 25 and guide concave part 26 are respectively mated to the guide support concave part 15 and second guide support 14, the reference in incorporation work can be easily checked.

Figure 9:
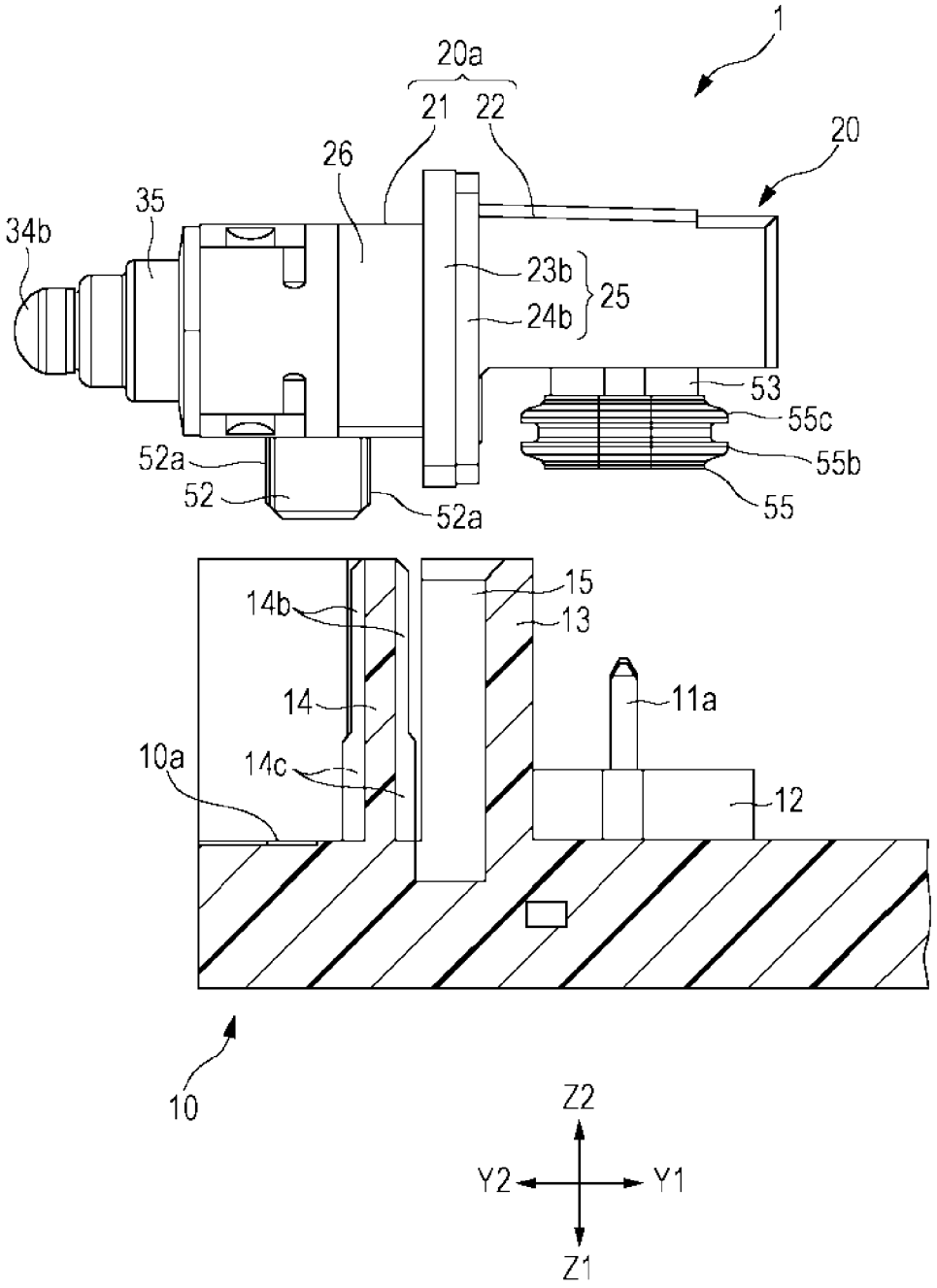
FIG. 9 is a side view illustrating a process to attach the switch device to the external base material.
Figure 10:
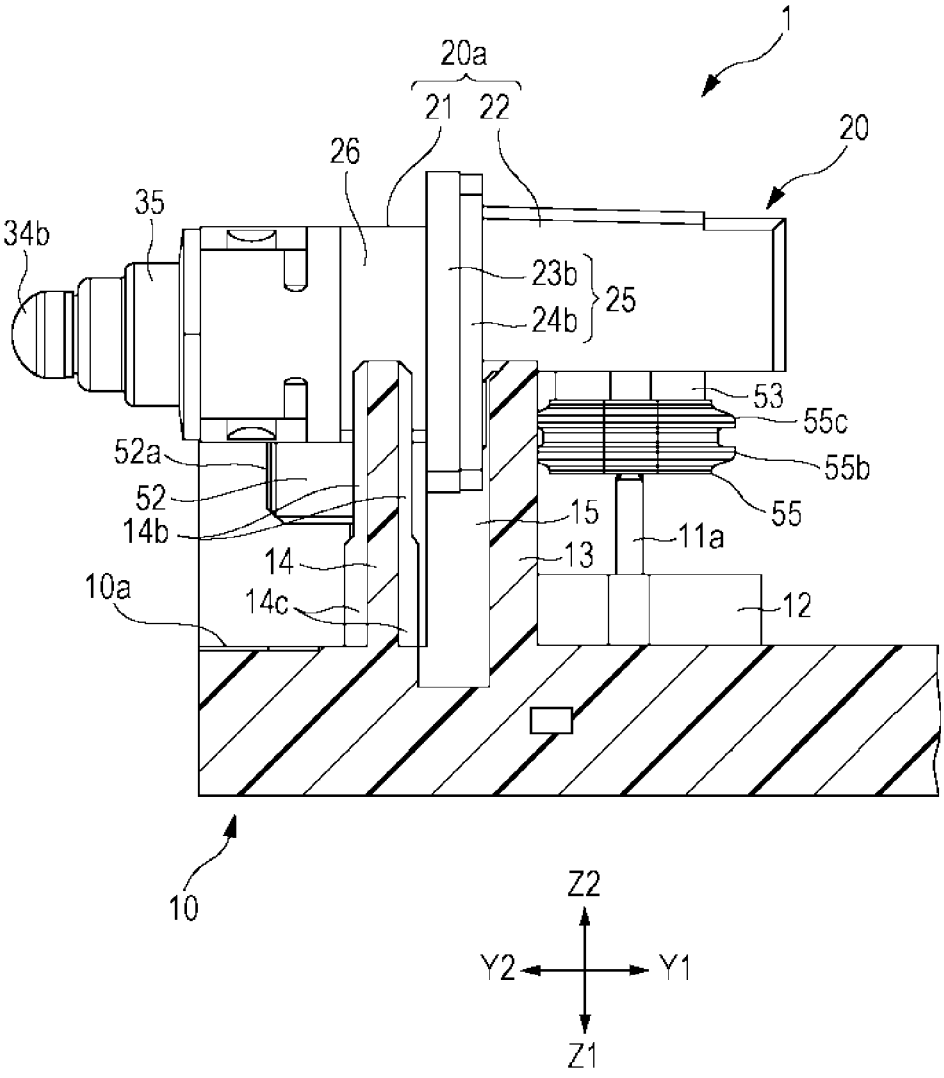
FIG. 10 is a side view illustrating a process to attach the switch device to the external base material.

As illustrated in FIGS. 1, 9, and 10, in the attachment of the switch device 20 to the external base material 10, the guide protrusion 25 provided on each of the sides of the housing 20*a* on the X1 and X2 sides is inserted, from above, into the relevant guide support concave part 15 formed between the first guide support 13 and the second guide support 14 provided on the external base material 10. Similarly, the guide concave part 26 provided on each of the sides of the housing 20*a* on the X1 and X2 sides is placed, from above, on the relevant second guide support 14, which is a guide support protrusion. This enables the switch device 20 to be guided toward the attachment position on the external base material 10.

As illustrated in FIG. 10, at the beginning of the mating of the guide protrusion 25 and guide concave part 26 of the switch device 20 to the guide support concave part 15 and second guide support 14, the positioning bosses 51 and 52 provided on the first case 21 are separated from the external base material 10 and the openings 54 formed in the second case 22 are also separated from the external terminal 11*a* fixed to the external base material 10.

Figure 11:
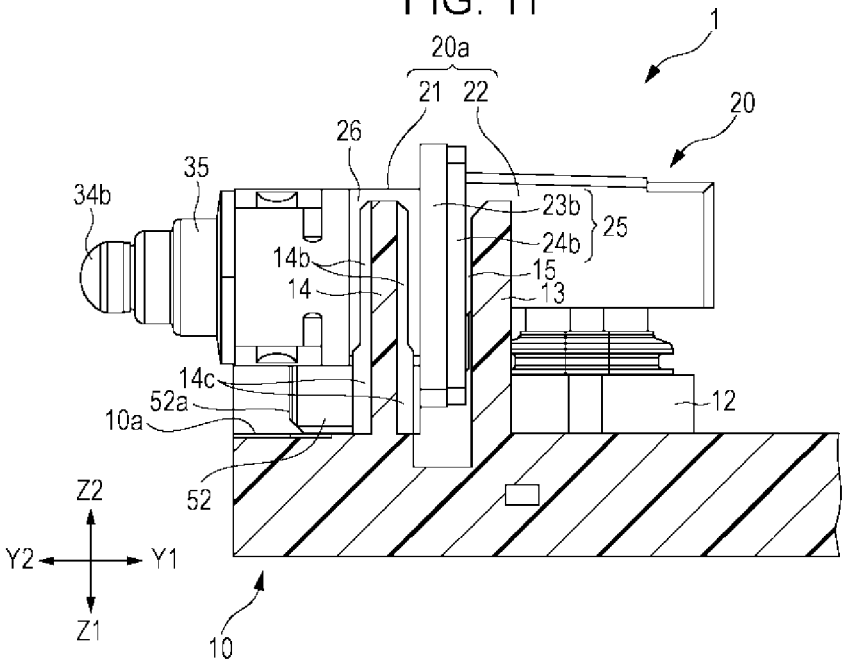
FIG. 11 is a side view illustrating a process to attach the switch device to the external base material.

When the switch device 20 is then lowered to the position indicated in FIG. 11, each external terminal 11*a* enters the interior of the relevant opening 54 in the second case 22. At this point in time, however, the contact pieces 48 and 49 of each of the terminal connecting parts 40*a* and 40*b* in the second case 22 are still separated a little from the external terminal 11*a*, as illustrated in FIG. 13.

When the switch device 20 is further pressed in the Z1 direction, the positioning bosses 51 and 52 respectively enter the interiors of the positioning concave parts 16*a* and 16*b* formed in the external base material 10. As illustrated in FIG. 3, the positioning concave part 16*a* on the X2 side is perfectly circular, and the positioning concave part 16*b* on the X1 side is formed so as to be slightly long in the X1-X2 direction. Therefore, the position at which the switch device 20 is to be disposed on the external base material 10 is determined with respect to the concave and convex fitting part between the positioning concave part 16*a* and the positioning boss 51 disposed on the X2 side. The positioning boss 51, which has the pressure contact ribs 51*a*, is inserted into the positioning concave part 16*a* without a clearance. The positioning boss 52, which has the pressure contact rib 52*a* protruding in the Y1-Y2 direction, is positioned and attached in the positioning concave part 16*b* without a clearance in the Y1-Y2 direction.

Figure 12:
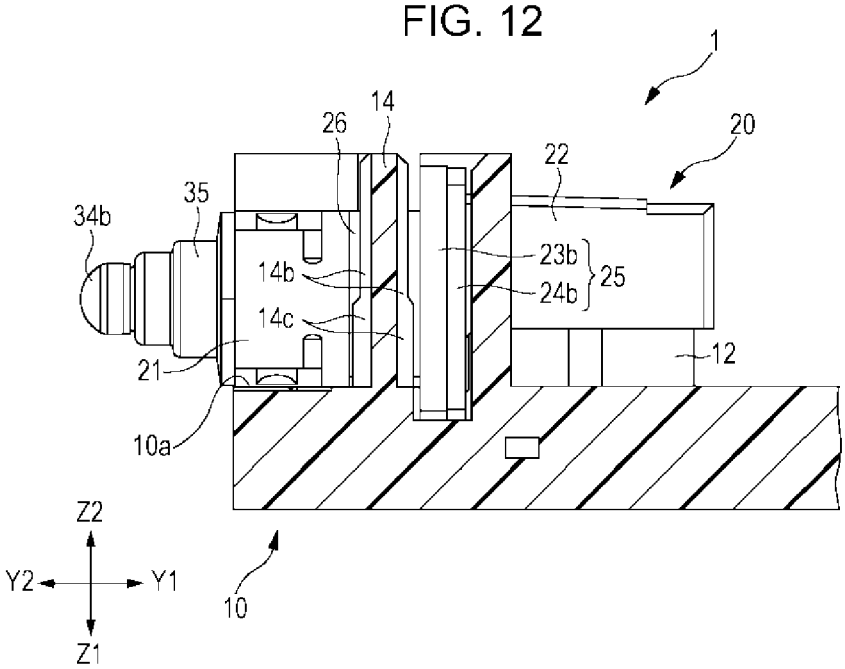
FIG. 12 is a side view illustrating a state in which the switch device has been attached to the external base material.

When the switch device 20 is further pressed in the state in FIGS. 11 and 13, the positioning bosses 51 and 52 respectively enter the positioning concave parts 16*a* and 16*b*, immediately after which the pair of external terminals 11*a* enter the clearance between the pair of contact pieces 48 and 49 of the terminal connecting parts 40*a* and terminal connecting part 40*b* in the second case 22. The hook 14*a* formed as part of the second guide support 14 of the external base material 10 is engaged to the upper surface of the first case 21, fixing the switch device 20 on the external base material 10. This completes the attachment of the switch device 20 as illustrated in FIGS. 12 and 14.

As illustrated in FIGS. 13 and 14, the front surface 27*i* of the positioning wall 27*a* of the terminal holding member 27 abuts the butting surface 21*b* of the first case 21 to position the terminal holding member 27 with respect to the first case 21. In addition, the terminal connecting part 40*a* is positioned and fixed to the first internal terminal 31 by the fixing protrusion 27*j*, and the terminal connecting part 40*b* is positioned and fixed to the second internal terminal 32 by the fixing protrusion 27*k*, the first internal terminal 31 and second internal terminal 32 being held to the terminal holding member 27 by an insert molding method. Therefore, the positions of the terminal connecting parts 40*a* and 40*b* relative to the positioning bosses 51 and 52 formed in the first case 21 are highly precisely determined.

As described above, immediately after the positioning boss 51 has entered the positioning concave part 16*a* and the positioning boss 52 has entered positioning concave part 16*b*, each of the pair of external terminals 11*a* enters a clearance between the contact pieces 48 and 49 of one of the two terminal connection parts 40*a* and 40*b*. Since the relative positions between the positioning boss 51 and the terminal connecting part 40*a* and between the positioning boss 52 and the terminal connecting part 40*b* are highly precisely determined, it is possible to reliably insert each of the pair of external terminals 11*a* into the clearance between the contact pieces 48 and 49 of one of the two terminal connection parts 40*a* and 40*b*.

As illustrated in FIG. 4, the fitting protrusion 53 is formed on the second case 22, the openings 54 are formed in the fitting protrusion 53, and the sealing member 55 is attached to the outer circumference of the fitting protrusion 53. Therefore, when the switch device 20 is pressed against to the attachment surface 10*a* of the external base material 10 as illustrated in FIGS. 13 and 14, the sealing member 55 enters the interior of the tube 12 formed in the external base material 10.

The lower elongated protrusion 55*b* and upper elongated protrusion 55*c* are formed on the outer circumferential surface of the sealing member 55. The outside dimensions of the lower elongated protrusion 55*b* and upper elongated protrusion 55*c* are larger than the inner dimension of the wall surface 12*a*, which is the inner surface of the tube 12. However, since the lower portion, with the height of H, of the sealing member 55, the lower portion being the lower elongated protrusion 55*b*, further protrudes downward relative to the lower end of the fitting protrusion 53, as illustrated in FIG. 13, the sealing member 55 is likely to be deformed toward the center at the portion with the height of H. The upper portion of the wall surface 12*a* forms a tapered surface 12*b*, the dimension of which is gradually increased.

Therefore, when the switch device 20 is pressed in the Z1 direction, the lower elongated protrusion 55*b* is guided by the tapered surface 12*b*. This portion becomes likely to be contracted toward the center. This enables the lower elongated protrusion 55*b* to easily enter the space inside of the wall surface 12*a*. After that, an upper portion, of the sealing member 55, that internally has the fitting protrusion 53 enters the space inside of the wall surface 12*a*, so the lower elongated protrusion 55*b* and upper elongated protrusion 55*c* are compressed and placed in tight contact with the wall surface 12*a*. Therefore, it is possible to reliably seal a portion at which the fitting protrusion 53 is attached to the wall surface 12*a*.

That is, although the sealing member 55 is disposed at the bottom part of the second case 22 and the position of the sealing member 55 cannot thereby be visually checked from above, if the switch device 20 is attached to the attachment surface 10*a* of the external base material 10 in such a way that the guide protrusion 25 and guide concave part 26 are respectively combined with the guide support concave part 15 and second guide support 14 from above, it is possible to easily insert the sealing member 55 into the space inside of the wall surface 12*a*.

As illustrated in FIG. 14, the interior of the housing 20*a* can be sealed with the 20 attached to the external base material 10, so it is possible to prevent moisture and oil from entering the interior of the housing 20*a*. With the switch device 20, the positioning wall 27*a* of the terminal holding member 27 is interposed at the boundary between the first case 21 and the second case 22. The positioning wall 27*a* completely separates the internal space of the first case 21 and the internal space of the second case 22 from each other. More preferably, if the flange 23 of the first case 21 and the flange 24 of the second case 22 are bonded by being continuously welded along their outer circumferences, contact sliding parts in the first case 21 between the movable contact 36 and the first internal terminal 31 and between the movable contact 36 and the second internal terminal 32 can be placed in a sealed space, so it is possible to prevent moisture, oil, and the like from entering the space.

The internal space of the second case 22 is also completely isolated from the outside by a sealing structure formed by placing the sealing member 55 in tight contact with the wall surface 12*a*, so it is possible to prevent moisture, oil, and the like from entering the internal space.

As illustrated in FIG. 7 and FIGS. 8A and 8B, since the first support elastic pieces 43 and 44 of the terminal connecting parts 40*a* and 40*b* are elastically deformable in the front-and-back direction (Y1-Y2 direction), the contact base 47 having the contact pieces 48 and 49 can move in the front-and-back direction (Y1-Y2 direction). That is, the contact pieces 48 and 49 can move in the front-and-back direction (Y1-Y2 direction), in which they hold the external terminal 11*a*. Therefore, when the external terminal 11*a* is inserted into the clearance between the contact pieces 48 and 49 during the attachment of the switch device 20 to the external base material 10, the contact pieces 48 and 49 can hold the external terminal 11*a* so as to follow the external terminal 11*a* while moving in the front-and-back direction, in which the contact pieces 48 and 49 hold the external terminal 11*a*. After having been held by the contact pieces 48 and 49, the external terminal 11*a* remains held by them from the front-and-back direction with even forces.

The contact base 47 having the contact pieces 48 and 49 can further move in the right-and-left direction (X1-X2 direction) due to the elastic deformation of the second support elastic pieces 45 and 46. Therefore, when the contact pieces 48 and 49 hold the external terminal 11*a*, they can also follow the right-and-left movement of the external terminal 11*a*.

External vibration may be exerted on the detecting apparatus 1 while the detecting apparatus 1 into which the switch device 20 has been incorporated is being used, and the switch device 20 and external base material 10 may thereby move relatively. Even in this case, since the first support elastic pieces 43 and 44 and second support elastic pieces 45 and 46 of the terminal connecting parts 40*a* and 40*b* elastically deform, the contact pieces 48 and 49 can follow the relative vibration of the external terminal 11*a*.

As illustrated in FIGS. 13 and 14, the second case 22 of the switch device 20 has the openings 54 in the fitting protrusion 53 formed at the bottom part, the openings 54 being long in the vertical direction (Z1-Z2 direction). In the second case 22, the insertion part 31*c* of the first internal terminal 31 faces the interior of the relevant opening 54, and the insertion part 32*c* of the second internal terminal 32 also faces the interior of the relevant opening 54. The contact pieces 48 and 49, which are part of each of the terminal connecting part 40*a* included in the first internal terminal 31 and the terminal connecting part 40*b* included in the second internal terminal 32, are disposed opposite to the relevant opening 54.

In the second case 22, the distance from the lower end of each opening 54 to the contact pieces 48 and 49 is long, and the insertion part 31*c* or insertion part 32*c*, whichever is appropriate, is present therebetween. Therefore, even if, in the switch device 20 before it is attached to the external base material 10, a foreign material enters the opening 54 from the outside, a force with which deformation is caused and the like are not easily applied to the contact pieces 48 and 49.

The internal space of the second case 22 is divided into two by the partition wall 27*h* of the terminal holding member 27 in the X1-X2 direction. Therefore, the terminal connecting part 40*a* fixed to the first internal terminal 31 and the terminal connecting part 40*b* fixed to the second internal terminal 32 can be placed in different spaces. Therefore, even when the second case 22 is made compact, a short-circuit does not occur between the terminal connecting part 40*a* and the terminal connecting part 40*b*, which would otherwise be caused when they come into contact with each other.

Figure 15A:
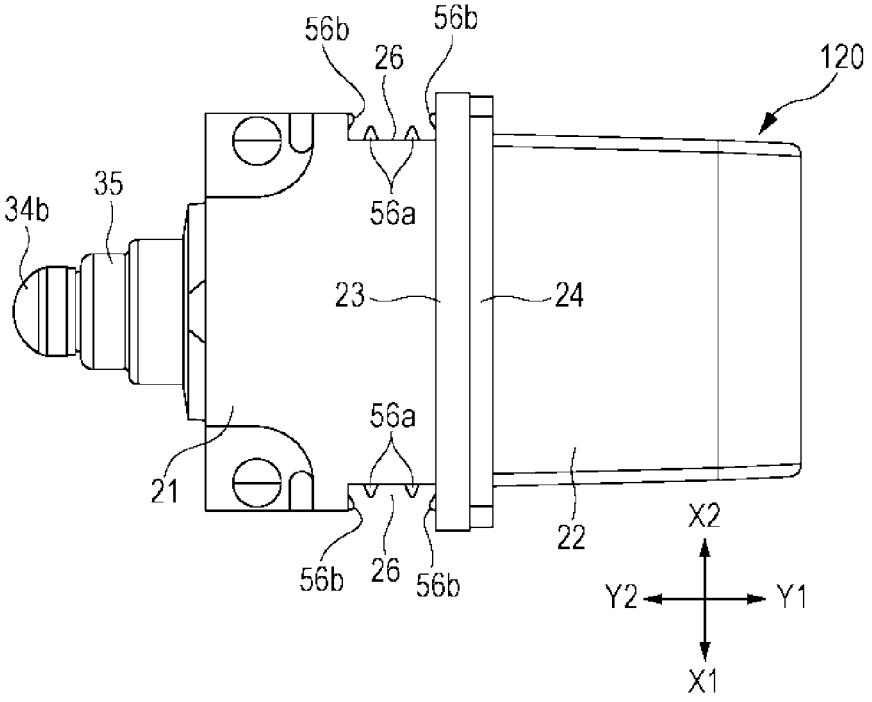
FIG. 15A is a plan view illustrating a switch device in a second embodiment of the present invention.
Figure 15B:
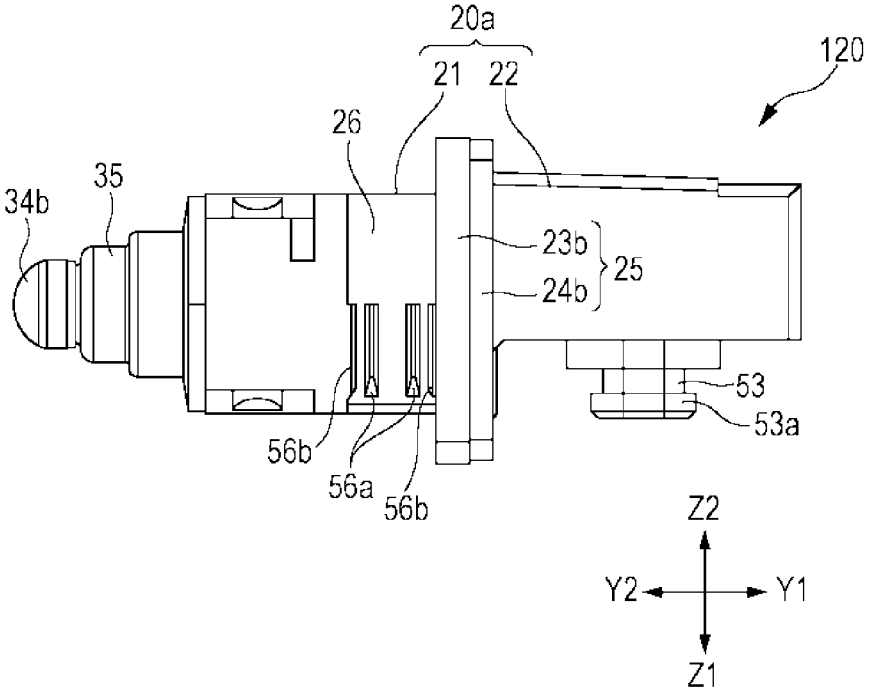
FIG. 15B is a side view of the switch device.
Figure 16:
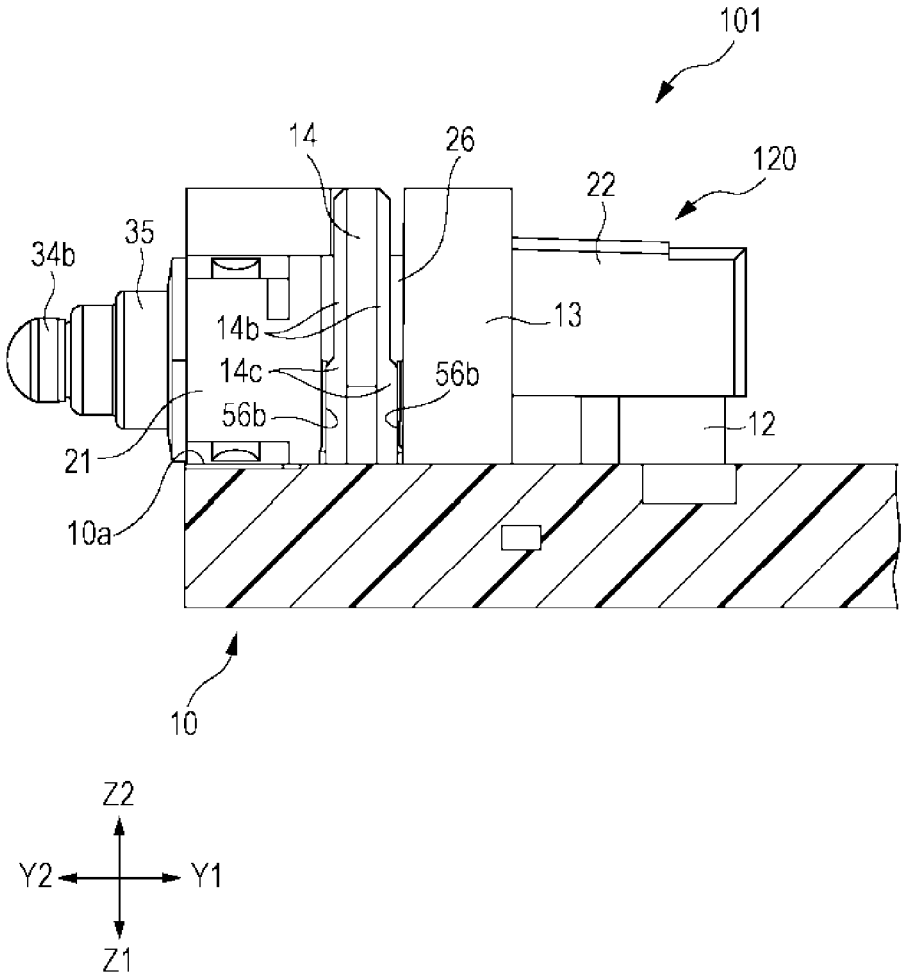
FIG. 16 is a side view illustrating a state in which, in a detecting apparatus in the second embodiment of the present invention, the switch device has been attached to the external base material.

FIGS. 15A and 15B illustrate a switch device 120 in a second embodiment of the present invention. FIG. 16 illustrates a detecting apparatus 101, in the second embodiment, with the switch device 120 attached to the external base material 10. Structural parts, in the second embodiment, that have the same functions as in the first embodiment will be assigned the same reference characters, and detailed descriptions will be omitted.

In the housing 20*a* of the switch device 120 in the second embodiment, the first case 21 lacks the positioning bosses 51 and 52. Instead, as illustrated in FIGS. 15A and 15B, the switch device 120 in the second embodiment preferably has pressure contact ribs 56*a* and 56*b* in the guide concave part 26 as a positioning structure. Two pressure contact ribs 56*a* are formed on the inner surface, facing in the X1 direction, of the guide concave part 26 on the X1 side so as to extend in the vertical direction. Similarly, other two pressure contact ribs 56*a* are formed on the inner surface, facing in the X2 direction, of the guide concave part 26 on the X2 side. Two pressure contact ribs 56*b* are formed on the inner end surfaces facing in the front-and-back direction (Y1-Y2 direction) of each guide concave part 26 so as to extend in the front-and-back direction, one pressure contact rib 56*b* on one inner end surface. As illustrated in FIG. 15B, the pressure contact ribs 56*a* and 56*b* are provided only in the lower portion in the guide concave part 26.

The external base material 10 to which the switch device 120 is attached is the same as the external base material 10 that has been illustrated in FIG. 3 in the first embodiment. However, the positioning concave parts 16*a* and 16*b* are unnecessary.

In processes to attach the switch device 120 to the external base material 10, the guide protrusion 25 and guide concave part 26 formed in the housing 20*a* are respectively mated to the guide support concave part 15 and second guide support 14 formed in the external base material 10 so as to be guided, after which the switch device 120 is pressed downward, that is, toward the attachment surface 10*a* of the external base material 10, as in the attachment processes, in the first embodiment, illustrated in FIGS. 9 to 11. When the switch device 120 is pressed downward from the position illustrated in FIG. 11 to the position illustrated in FIG. 12 as in the first embodiment, each pressure contact rib 56*a* formed in the guide concave part 26 comes into pressure contact with the opposing surface of the second guide support 14, and each pressure contact rib 56*b* comes into pressure contact with the relevant wide-width part 14*c*, which is the lower portion of the relevant guide rib 14*b*, as illustrated in FIG. 16. As a result, the switch device 120 is positioned on the external base material 10. Then, the hook 14*a* formed as part of the second guide support 14 is engaged to the upper surface of the first case 21.

In the second embodiment as well, the switch device 120 is guided by the first guide supports 13 and second guide supports 14 and is led to the attachment surface 10*a* of the external base material 10. The switch device 120 is then positioned by the pressure contact ribs 56*a* and 56*b* constituting a positioning structure at the final stage of the processes to press the switch device 120 downward.

In the present invention, the terminal connecting part 40*a* may be integrally formed on the first internal terminal 31 and the terminal connecting part 40*b* may be integrally formed on the second internal terminal 32, instead of being attached as separate parts.

What is claimed is:

1. A switch device comprising:

a housing;

at least two internal terminals provided in the housing;

a movable contact; and a manipulation body that operates the movable contact; wherein an opening into which an external terminal is insertable is disposed in the housing, each internal terminal has a contact touching part that is electrically connected to the movable contact and has a terminal connecting part connectable to the external terminal inserted into the housing, and the housing has at least one of a guide concave part and a guide protrusion that guides the housing toward an external base material to which the external terminal is fixed, and that extend in a direction in which the external terminal is inserted, wherein:

the housing has a bottom part facing an attachment surface of the external base material to which the external terminal is fixed and also has two side parts erected from the attachment surface with the bottom part intervening between the two side parts;

the opening is in the bottom part; and each of the two side parts has at least one of the guide concave part and the guide protrusion.

2. The switch device according to claim 1, wherein at least one of the guide concave part and the guide protrusion is provided between the opening and the manipulation body.

3. The switch device according to claim 1, wherein:

the housing is comprises a first case and a second case together combined together; and the guide protrusion is at a portion at which the first case and the second case are combined together.

4. The switch device according to claim 3, wherein the guide concave part is in one of the first case and the second case.

5. The switch device according to claim 3, wherein:

the housing comprises the first case and the second case combined together;

the guide protrusion is at a portion at which the first case and the second case are combined together; and the guide concave part is in one of the first case and the second case.

6. The switch device according to claim 3, wherein:

the first case has the manipulation body and the movable contact;

the second case has the opening; and the terminal connecting part is disposed in the second case.

7. The switch device according to claim 3, wherein one of the first case and the second case has a positioning structure that achieves positioning on the external base material to which the external terminal is fixed.

8. The switch device according to claim 7, wherein the internal terminals are incorporated with respect to the case having the positioning structure.

9. The switch device according to claim 8, wherein:

the internal terminals are held by a terminal holding member; and the terminal holding member is positioned by abutting the case having the positioning structure.

10. The switch device according to claim 9, wherein:

the terminal holding member has a partition wall; and the terminal connecting parts are disposed with the partition wall intervening between the terminal connecting parts.

11. The switch device according to claim 7, wherein the positioning structure has a positioning boss protruding from the case toward the external base material.

12. The switch device according to claim 7, wherein the positioning structure has a rib disposed on an inner surface of the guide concave part.

13. The switch device according to claim 1, wherein:

a fitting protrusion is on the housing so as to protrude in the direction in which the external terminal is inserted from the bottom part;

the opening is in the fitting protrusion; and a sealing member made of an elastic material is attached to an outer circumference of the fitting protrusion.

14. The switch device according to claim 13, wherein the sealing member is vertically symmetric in the direction in which the external terminal is inserted.

15. A detecting apparatus comprising:

a switch device comprising:

a housing;

at least two internal terminals provided in the housing;

a movable contact; and a manipulation body that operates the movable contact; wherein an opening into which an external terminal is insertable is disposed in the housing, each internal terminal has a contact touching part that is electrically connected to the movable contact and has a terminal connecting part connectable to the external terminal inserted into the housing, and the housing has at least one of a guide concave part and a guide protrusion that extend in a direction in which the external terminal is inserted;

an external base material;

at least two external terminals fixed to the external base material; and a guide support formed on the external base material so as to be oriented in a direction in which the external terminals extend; wherein the switch device is disposed on the external base material, at least one of the guide concave part and the guide protrusion is guided by the guide support, and the external terminals enter an interior of the housing from the opening and are connected to the terminal connecting parts.

16. A detecting apparatus comprising:

the switch device comprising:

a housing;

at least two internal terminals provided in the housing;

a movable contact; and a manipulation body that operates the movable contact; wherein an opening into which an external terminal is insertable is disposed in the housing, each internal terminal has a contact touching part that is electrically connected to the movable contact and has a terminal connecting part connectable to the external terminal inserted into the housing, and the housing has at least one of a guide concave part and a guide protrusion that extend in a direction in which the external terminal is inserted;

the housing is comprises a first case and a second case together combined together;

the guide protrusion is at a portion at which the first case and the second case are combined together; and wherein one of the first case and the second case has a positioning structure that achieves positioning on the external base material to which the external terminal is fixed;

an external base material;

at least two external terminals fixed to the external base material;

a positioning support formed in the external base material; and a guide support formed on the external base material so as to be oriented in a direction in which the external terminals extend; wherein the switch device is disposed on the external base material, at least one of the guide concave part and the guide protrusion is guided by the guide support, the housing is positioned by fitting the positioning structure and the positioning support to each other, and the external terminals enter an interior of the housing from the opening and are connected to the terminal connecting parts.

17. A detecting apparatus comprising:

a switch device comprising:

a housing;

at least two internal terminals provided in the housing;

a movable contact; and a manipulation body that operates the movable contact; wherein an opening into which an external terminal is insertable is disposed in the housing, each internal terminal has a contact touching part that is electrically connected to the movable contact and has a terminal connecting part connectable to the external terminal inserted into the housing, and the housing has at least one of a guide concave part and a guide protrusion that extend in a direction in which the external terminal is inserted;

wherein:

a fitting protrusion is on the housing so as to protrude in the direction in which the external terminal is inserted from the bottom part;

the opening is in the fitting protrusion; and a sealing member made of an elastic material is attached to an outer circumference of the fitting protrusion;

an external base material;

at least two external terminals fixed to the external base material; and a guide support formed on the external base material so as to be oriented in a direction in which the external terminals extend; wherein the switch device is disposed on the external base material, at least one of the guide concave part and the guide protrusion is guided by the guide support, the external terminals enter an interior of the housing from the opening and are connected to the terminal connecting parts, a wall surface enclosing the external terminals is formed on the outer base material, and the sealing member is attached between the fitting protrusion and the wall surface.

* * * * *